US005599128A

United States Patent [19]

Steiner

[11] Patent Number: 5,599,128

[45] Date of Patent: Feb. 4, 1997

[54] SEPARATING MEANS FOR BOUND PRINTED WORKS WITH TABS PROJECTING FROM THE PLANE OF THE BOUND PRINTED WORKS

[76] Inventor: Andreas Steiner, Eichendorffstrasse 28, D-8228 Freilassing, Germany

[21] Appl. No.: 338,469

[22] PCT Filed: May 28, 1993

[86] PCT No.: PCT/EP93/01345

§ 371 Date: Feb. 22, 1995

§ 102(e) Date: Feb. 22, 1995

[87] PCT Pub. No.: WO93/24336

PCT Pub. Date: Dec. 9, 1993

[30] Foreign Application Priority Data

May 29, 1992 [DE] Germany ..... 9207326 U

[51] Int. Cl.[6] ..... B42F 21/00

[52] U.S. Cl. ..... 402/79; 281/38; 281/36; 281/37; 281/41

[58] Field of Search ..... 283/36–43; 402/79; 281/38

[56] References Cited

U.S. PATENT DOCUMENTS

| | | | |
|---|---|---|---|
| 876,767 | 1/1908 | Boggs | 283/36 |
| 1,241,049 | 9/1917 | Stevens | 283/36 |
| 1,510,280 | 9/1924 | Janney | 283/36 |
| 1,924,755 | 8/1933 | Rubin | 283/36 |
| 2,195,646 | 4/1940 | Green | 283/38 |
| 3,324,823 | 6/1967 | Peters . | |
| 4,422,672 | 12/1983 | Levi | 283/39 |
| 4,575,126 | 3/1986 | Grubbs | 283/38 |

FOREIGN PATENT DOCUMENTS

| | | | |
|---|---|---|---|
| 107439 | 5/1927 | Austria | 283/39 |
| 821198 | 11/1951 | Germany | 283/41 |
| 1738229 | 1/1957 | Germany . | |
| 2302847 | 7/1974 | Germany . | |
| 7529534 | 4/1976 | Germany . | |
| 227148 | 11/1940 | Switzerland | 283/39 |
| 372281 | 11/1963 | Switzerland . | |
| 437209 | 11/1967 | Switzerland . | |

*Primary Examiner*—Frances Han

*Attorney, Agent, or Firm*—Antonelli, Terry, Stout & Kraus

[57] ABSTRACT

A separating sheet for bound printed works, with the separating sheet including at least one tab projecting out of the plain of the bound printed works. The separating sheet has an inside edge opposite the at least one tab, with the inside edge having a width greater than a width of the at least one tab. An adhesive material attaches the separating sheet to an inside of the bound printed works, and on a side of the separating sheet facing the inside of the bound printed works, insert tabs are provided, With the insert tabs extending in a direction opposite an extension direction of the at least one tab.

4 Claims, 3 Drawing Sheets

SEPARATING MEANS FOR BOUND PRINTED WORKS WITH TABS PROJECTING FROM THE PLANE OF THE BOUND PRINTED WORKS

FIELD OF THE INVENTION

The present invention relates to a separating means for bound printed works with a tab which projects from a plane of the bound printed works.

BACKGROUND OF THE INVENTION

Separating means of the aforementioned type are generally known and, for example, separating means have been proposed which are fashioned as tabs which can be glued or adhesively secured to book pages and which are attached later using adhesive to one of the outside edges of the book page by the user on certain pages of the book which, for example, must be frequently used. These separating means make it possible, for example, to quickly open a book to a certain page. This can take place with separating means in the form of projecting tabs, for example, using one hand by grasping the book with the fingers of one hand and placing the thumb on the tab. By tilting the book accordingly all pages of the book can be opened up to the tab while the pages behind remain closed.

A disadvantage of this type of separating means resides in the fact that when the tabs are attached later to the book page, the book page can be damaged. Even when using the separating means in the form described above, book pages consisting of very thin paper can be damaged since, when opening the book, considerable forces are exerted on the paper of the book page by the held tab, especially when the pulling action of the tab is exerted at an offset angle.

SUMMARY OF THE INVENTION

The aim underlying the present invention essentially resides in avoiding the above noted disadvantages and to provide a separating means for bound printed works which can be easily operated, in which there is no danger that sensitive book pages can be damaged, and which can be attached later without any great difficulty in the bound printed work such as books, catalogs, computer handbooks and the like.

In accordance with advantageous features of the present invention, a separating means is provided which is in the form of a separating sheet having an inside edge opposite to a tab or tabs, with an inside edge of the separating sheet having a width greater than a width of the tab or tabs and an adhesive material for attachment to an inside of the bound printed works.

On a side of the separating sheet opposite an inside of the book, one or more folds may be provided.

The adhesive material in accordance with the present invention may be in the form of adhesive strips and, it is also possible to provide, on a side of the separating means facing the inside of the book one or more insert tabs.

Advantageously, the separating sheets have markings in the form of marking lines or perforations for enabling an adaptation to different book formats.

The separating sheets may have tabs in different numbers for separating sheets and in different positions.

The separating means according to the invention includes a separate separating sheet which can be glued or adhesively secured into the bound printed work. The separating sheet may be fashioned of a durable paper, a plastic film or a similar pliable material which can be glued or adhesively secured into the space between two pages of the bound printed work without any problems. A tab is attached on one of the outside edges which corresponds to an outside edge of the book, with the tab being dimensioned such that the tab projects out of the format of the bound printed work. On the inside edge of the bound printed work opposite the tab, the separating sheet can be provided with adhesive material so that it can be glued or adhesively secured to the inside of the book with the pages. In this manner, the separating means is permanently attached to the book. The inside edge of the separating sheet opposite the tab is wider than the width of the tab itself so that the forces which occur when the tab is being held and when paging through the book can be uniformly distributed on the inside edge of the book, also by friction on the adjacent book pages over the latter without damaging or tearing out the separating sheet.

Preferably, according to the invention, the separating sheet may have one or more folds extending in parallel to an inside edge of the book, with the folds facilitating turning of the separating sheet and facilitating insertion and adhesive securing of the separating sheet into the book.

The layers of adhesive material provided on the separating sheet may preferably be in the form of adhesive strips, for example, with removable covers in order to prevent premature setting of the adhesive material.

BRIEF DESCRIPTION OF THE DRAWINGS

The above and other objects, features and advantages of the present invention will become more apparent from the following description when taken in connection with the accompanying drawings which show, for the purpose of illustration only, several embodiments in accordance with the present invention, and wherein.

DETAILED DESCRIPTION

Figure 1:
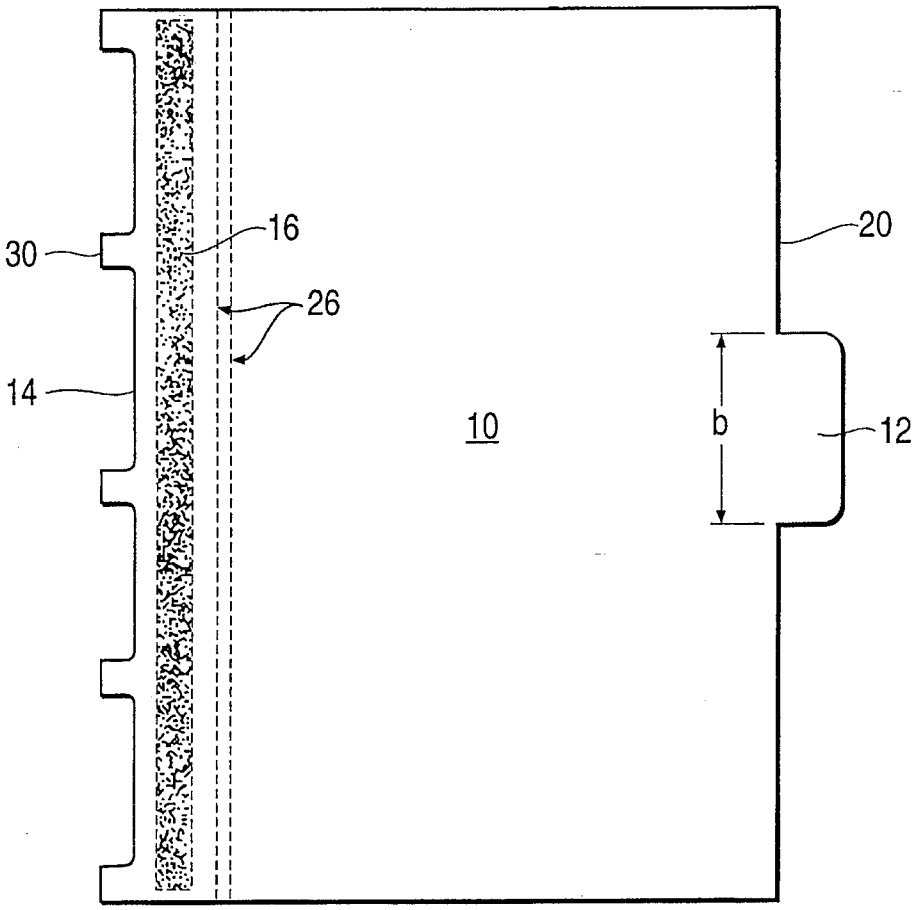
FIG. 1 is a top plan view of a separating sheet according to the present invention in a rectangular form.
Figure 3:
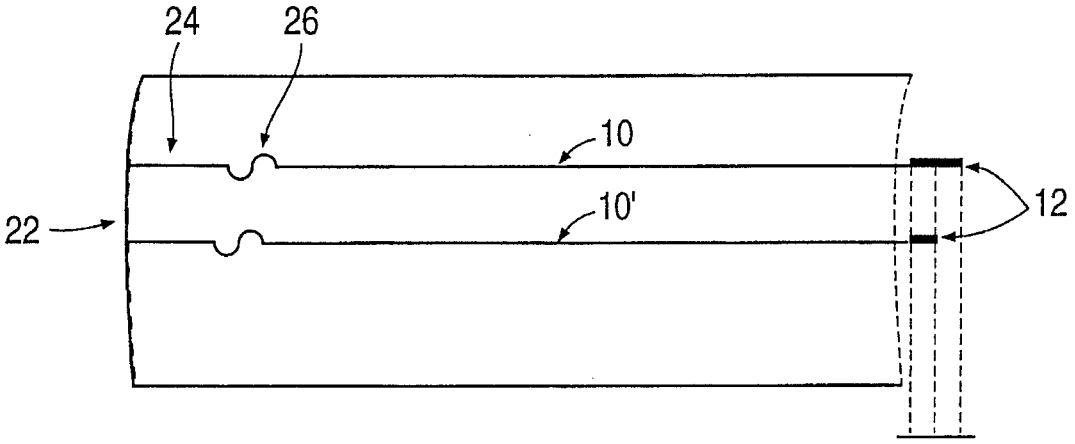
FIG. 3 is a schematic view of a book with separating sheets of the present invention inserted therein.

FIG. 1 shows a separating sheet taken in rectangular form with a tab 12 having a width b attached on a long outside edge 20 of the separating sheet 10. The tab 12 may be produced in one piece together with a separating sheet 10 and from the same material. Insert tabs 30 are provided on an inside edge 14 of the separating sheet, with the insert tabs 30 extending toward the inside of the bound printed work or book in a direction opposite to an extension direction of the tab 12 (FIG. 3). The insert tabs 30 facilitate deep insertion of the separating sheet 10 as far as the back of the cover of the book and it also may be used for adjustment of the separating sheet 10 in the book. Adhesive material 16, preferably in the form of a strip, is provided along an inside edge 14 of the separating sheet 10 and, if necessary, adhesive material can also be provided on the insert tabs 30. With this adhesive material 16, the separating sheet 10 is attached in the bound printed work or book. Folds 26 are provided so as to enable an easy printing of the separating sheet 10, especially when the separating sheet is glued onto the left side of the book and the book is also printed.

Figure 2:
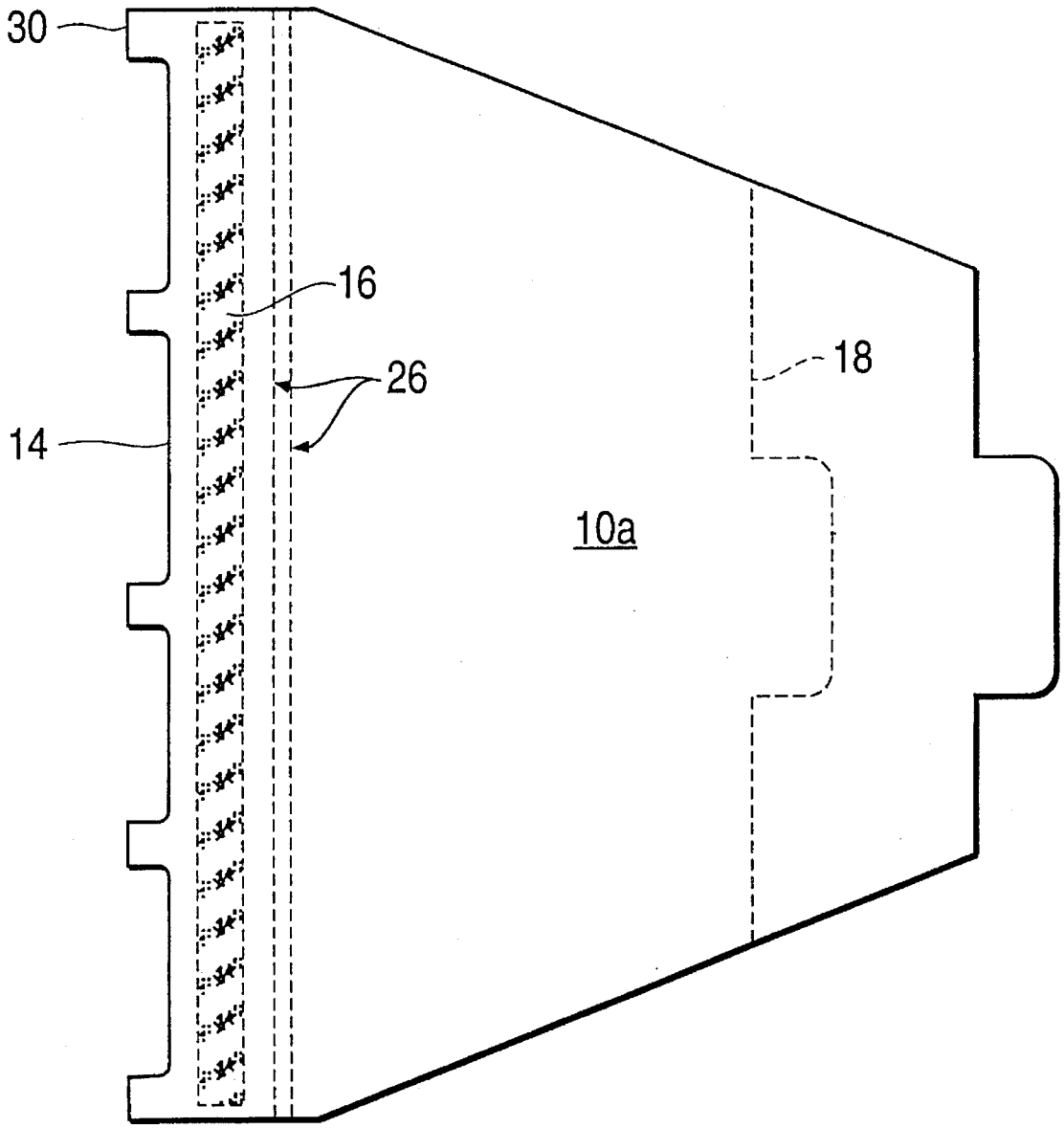
FIG. 2 is a top plan view of another embodiment of a separating sheet in accordance with the present invention in a non-rectangular form with a size which can be varied by a perforation.

FIG. 2 shows a similar separating sheet to that of FIG. 1 and deviates from the rectangular shape of the separating sheet 10 of FIG. 1 only in its shape by omitting the outside corners opposite the book cover. Moreover, the separating sheet 10*a* includes markings 26, for example, in the form of marking lines or perforations, along which the separating sheet 10*a* can be altered by cutting, creasing or tearing such that it can be matched to different book formats.

FIG. 3 illustrates a bound printed work or book with two inserted separating sheets 10, 10', in which tabs 12 are dimensioned differently. Moreover, the tabs 12 are made of a reinforced material as compared to the material of the separating sheets 10, 10'.

Figure 4:
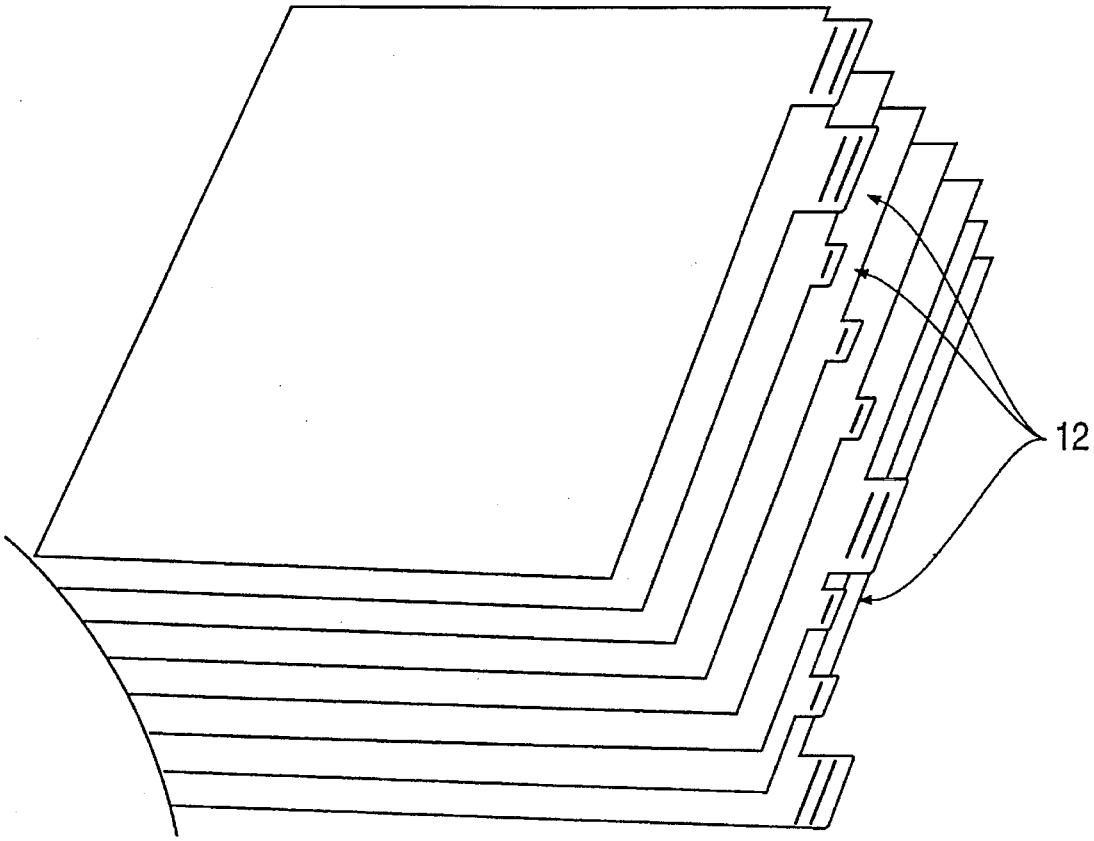
FIG. 4 is a perspective view of a book with separating sheets of the present invention inserted therein.

FIG. 4 illustrates separating sheets with differently sized or shaped tabs 12 and also provides an illustration as to the manner by which one or more separating sheets may have several tabs thereon.

Figure 5:
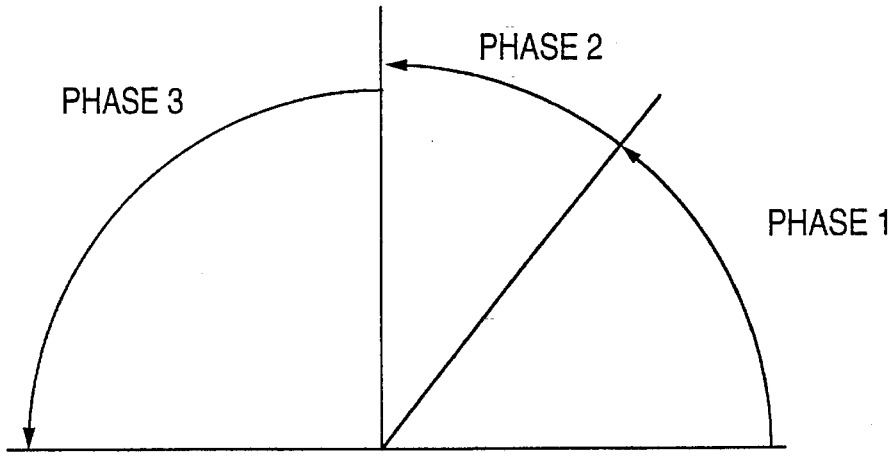
FIG. 5 is a schematic representation illustrating the phases of page turning.

FIG. 5 illustrates phases which occur when printing the pages of the book provided with separating means constructed in accordance with the present invention. In phase 1 of the turning of pages which is effected, for example, by moving a tab which projects on the right edge of FIG. 5 using the left thumb in an upward direction, the forces which occur on the tab or on the pages of the book are the greatest, since the pages still to be turned must be moved against the force of gravity and the inertial masses. These forces are, for the most part, absorbed by friction between the separating means and the pages to be turned so that the loading of the adhesive means and also the page of the bound printed work or book used as an adhesive base is low.

In phase 2, the tensile load of the adhesive site or support page is low due to the short lever between the inherent weight of the page to be turned and the counter force due to the separating means.

In phase 3, the pages to be turned fall in a direction of the arrow mostly due to their own weight, while the pages not be turned fall back into their original position due to their own weight in the opposite direction of the arrows of phases 1 and 2.

In all of these phases, while turning pages, the forces are not only distributed on the inside edge of the book not from the tab via the separating means, but are also exhausted by friction which does not represent any load for the back of the bound printed work or book. In this manner, a careful turning of the pages is guaranteed.

I claim:

1. Separating means for bound printed works having at least one tab which projects out of the plane of the bound printed works, wherein said separating means comprises a separating sheet having an inside edge opposite the at least one tab, the inside edge having a width greater than a width of the at least one tab, an adhesive material provided along the inside edge for enabling attachment of the separating sheet to an inside of the bound printed works, at least one fold provided on a side of said separating sheet facing the inside of the bound printed works, and insert tabs provided on the side of the separating sheet facing the inside of the bound printed works, said insert tabs extending in a direction opposite to an extension direction of said at least one tab.

2. Separating means according to claim 1, wherein said adhesive material is in the form of at least one adhesive strip.

3. Separating means according to claim 1, wherein said separating sheet includes one of marking lines and perforations for enabling an adaption of the separating sheet to differing formats of the bound printed works.

4. Separating means according to claim 1, wherein said separating sheet includes a plurality of tabs disposed at selected positions along an edge of the separating sheet opposite the inside edge thereof.

* * * * *